US006595711B2

(12) United States Patent
Hill

(10) Patent No.: US 6,595,711 B2
(45) Date of Patent: Jul. 22, 2003

(54) PRINTER CARTRIDGE HAVING A FOAM RETENTION CLIP

(75) Inventor: Brandan Hill, Louisville, CO (US)

(73) Assignee: Legacy Manufacturing, LLC, Denver, CO (US)

( * ) Notice: Subject to any disclaimer, the term of this patent is extended or adjusted under 35 U.S.C. 154(b) by 0 days.

(21) Appl. No.: 09/866,177

(22) Filed: May 25, 2001

(65) Prior Publication Data

US 2001/0046400 A1 Nov. 29, 2001

Related U.S. Application Data

(60) Provisional application No. 60/205,693, filed on May 26, 2000.

(51) Int. Cl.[7] ..... B41J 2/175

(52) U.S. Cl. ..... 400/470; 400/471; 347/86; 347/85

(58) Field of Search ..... 400/124.1, 470, 400/471, 124.01; 347/84, 85, 86

(56) References Cited

U.S. PATENT DOCUMENTS 4,545,694 A * 10/1985 Ninomiya et al. ..... 400/124.1
4,771,295 A * 9/1988 Baker et al. ..... 347/87
5,467,117 A * 11/1995 Evans et al. ..... 347/85
5,631,682 A * 5/1997 Takata ..... 347/86
5,666,146 A * 9/1997 Mochizuki et al. ..... 347/86
5,903,294 A * 5/1999 Abe et al. ..... 347/85
6,053,606 A * 4/2000 Yamaguchi et al. ..... 347/86
6,059,916 A * 5/2000 Betschon ..... 156/250
6,070,976 A * 6/2000 Takagi et al. ..... 347/86
6,106,112 A * 8/2000 Okubo et al. ..... 347/7
6,161,927 A * 12/2000 Long et al. ..... 347/86

* cited by examiner

*Primary Examiner*—Andrew H. Hirshfeld
*Assistant Examiner*—Dave A. Ghatt
(74) *Attorney, Agent, or Firm*—Gibson, Dunn & Crutcher LLP

(57) ABSTRACT

An ink printer cartridge is provided wherein ink is stored in a foam reservoir situated within an ink chamber. The foam reservoir does not substantially fill the interior space of the ink chamber, and in particular does not contact the lid of the cartridge. The foam reservoir is retained in place by means of a clip which abuts the top of the foam reservoir. In an embodiment, the clip may compress the foam. A number of features of clip are disclosed, including particular arrangements for fitting into the cartridge, and adjustments as to height and width.

10 Claims, 5 Drawing Sheets

| ITEM | QTY | PART NUMBER |
|---|---|---|
| 1 | 1 | CS_12031_A |
| 2 | 1 | CS_12032_A |
| 3 | 1 | CS_12037_A |
| 4 | 1 | CS_12053_A |
| 5 | 1 | CS_12050_X.0 |
| 6 | 1 | CS_11724_A |

NOTES: Unless Otherwis
1. Draft be 1° max.
2. Each cavity of a mu mold to be identified
3. Ejector pin marks a +/- .005" from surfa
4. Location of parting ejector pins to be c Legacy Technical Dra
5. Flash must be within
6. Parts to be free fr Use of a mold releas permitted unless pre
7. Parts to be double l
8. Regrind not permitte
9. △indicates key inspe

| ITEM | QTY | PART NUMBER |
|---|---|---|
| 1 | 1 | CS_12031_A |
| 2 | 1 | CS_12032_A |
| 3 | 1 | CS_12037_A |
| 4 | 1 | CS_12053_A |
| 5 | 1 | CS_12050_X.0 |
| 6 | 1 | CS_11724_A |

NOTES: Unless Otherwis
1. Draft be 1° max.
2. Each cavity of a mu mold to be identified.
3. Ejector pin marks a +/- .005" from surfa
4. Location of parting ejector pins to be c Legacy Technical Dire
5. Flash must be within
6. Parts to be free fr Use of a mold releas permitted unless pre
7. Parts to be double
8. Regrind not permitte
9. ⚠Indicates key inspe

SECTION A-A

SECTION A-A

PRINTER CARTRIDGE HAVING A FOAM RETENTION CLIP

CROSS REFERENCE TO RELATED APPLICATION

This application claims the benefit of U.S. Provisional Application No. 60/205,693, filed on May 26, 2000 the contents of which are hereby incorporated by reference.

BACKGROUND

1. Field of the Invention

The present invention relates to a cartridge useful for storing ink for use with a printer. Most typically, such a printer is an ink-jet printer such as is used in connection with a personal computer, although the present invention is not limited to any particular type of printer.

2. Description of Related Art

A common method of storing ink in a printer cartridge for use with an ink printer is to store the ink in a foam reservoir. The ink is extracted from the foam reservoir through a through-hole (nozzle port) in the cartridge so that it may ultimately be applied to the paper or other print medium.

In some cases, the extraction of ink from the foam reservoir is improved if the foam reservoir is compressed. In U.S. Pat. No. 5,158,377 of Suzuki et al. (which is merely one of a number of related patents of Suzuki et al., such as U.S. Pat. No. 4,969,759), it is disclosed to store a porous ink member in a space (ink tank) such that the ink member is compressed by the cover defining the top of the space. In such a configuration, the porous ink member substantially fills the ink supply-tank.

SUMMARY

The present invention provides a printer cartridge wherein the ink is stored in a foam reservoir situated within an ink chamber. The foam reservoir does not substantially fill the interior space of the ink chamber, and in particular does not contact the lid of the cartridge. In one embodiment, a retention clip compresses the foam into a smaller area than it would occupy if the retention clip was not present. In an alternate embodiment, the clip does not compress the foam, but instead serves to hold the foam in place.

A number of features of the retention clip are disclosed, including particular arrangements for fitting into the cartridge, and adjustments as to height and width.

DETAILED DESCRIPTION OF THE INVENTION

The invention relates to a number of features in a printer cartridge intended for use in an ink jet printer, although the invention is not limited to any particular field of use. The cartridge is described in overview, and then more particular aspects of the invention are described.

Figure 1:
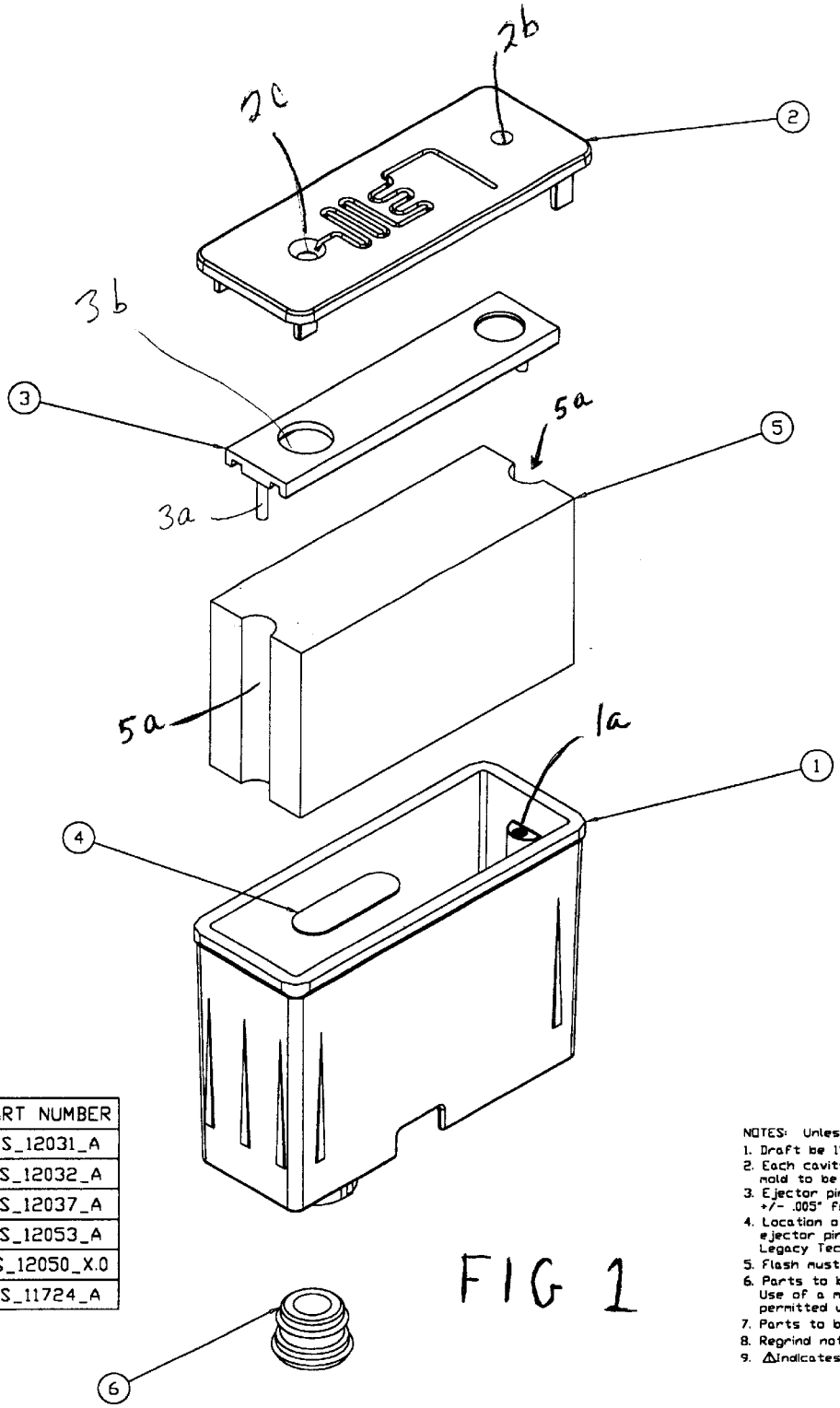
FIG. 1 is an exploded perspective view of an embodiment of the present invention.
Figure 2:
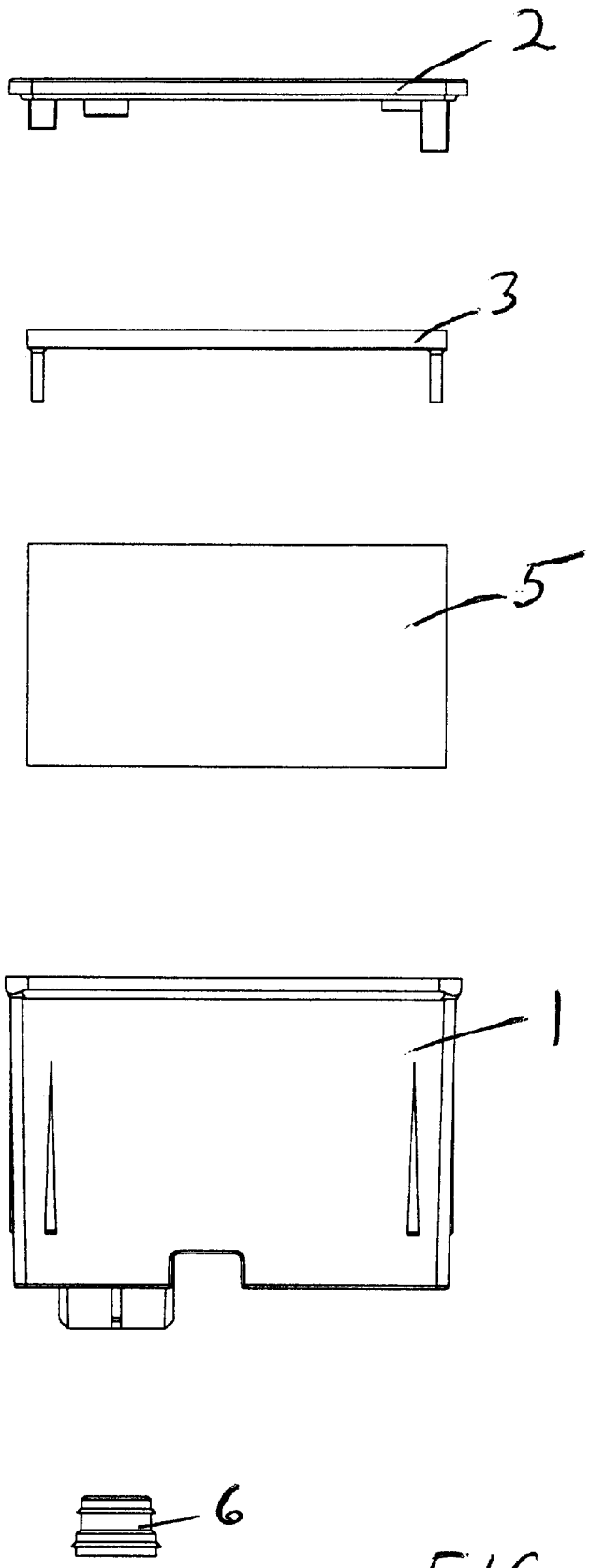
FIG. 2 is an exploded side elevation view of an embodiment of the present invention.

With reference to FIG. 1, an exploded perspective view of a cartridge constructed according to an embodiment of the invention is shown. The cartridge includes a base 1 which generally defines the exterior of the cartridge along with a lid 2. The base 1 and lid 2 define the interior space of the ink chamber. A foam reservoir 5 stores the ink in the ink chamber, as further discussed below. As used herein, "foam reservoir" is meant to include any material capable of absorbing ink from which the ink may then be extracted. The base 1 is shaped so as to mechanically key into a mating printhead. For example, the base 1 is shaped to fit into a particular printhead used in printers in current manufacture, but it could easily be shaped to fit into the printheads used in other printers.

The cartridge lid 2 forms the top of the cartridge and forms the upper boundary of the cartridge. The lid 2 engages the base 1 and is preferably hermetically sealed therewith such as by ultrasonic welding.

A retention clip 3 is situated within the interior space and engages ink base 1. The engagement could by a number of means. In this embodiment, the clip 3 has posts 3*a* which fit into boss receptacles 1*a* formed within section of the base 1 that defines the interior space. The clip 3 holds the foam in place and, in one embodiment, compresses the foam reservoir 5, as discussed below.

A screen 4 is situated in the bottom interior surface of the base 1 directly over a nozzle port 1*b* formed in the bottom of the base 1. The nozzle port 1*b* serves as the conduit through which ink is extracted from the cartridge. The purpose of the screen 4 is to filter ink of particulates and entrapped air as the ink passes from the foam reservoir 5 into the nozzle port.

As noted above, the foam reservoir 5 absorbs and stores ink within the cartridge for the purpose of on-demand delivery of ink to the nozzle port 1*b*. The ink is in turn supplied from the nozzle port 1*b* through a needle to the printhead.

A nozzle plug 6 is an elastomeric plug that fits into a lower portion of the nozzle port and forms a fluid tight barrier at the bottom of the nozzle port by virtue of an interference fit between the plug 6 and the section of the base 1 defining the nozzle port. The plug 6 is pierced by the needle, and forms a fluid tight seal with the needle so that ink can only exit the fluid port through the needle.

Figure 4:
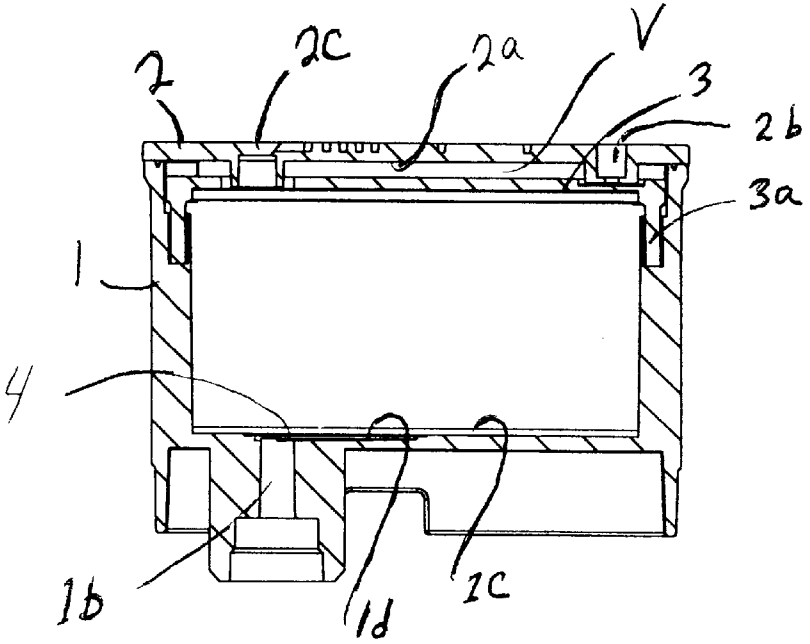
FIG. 4 is a section view of an embodiment of the present invention taken along the line A—A of FIG. 3.
Figure 3:
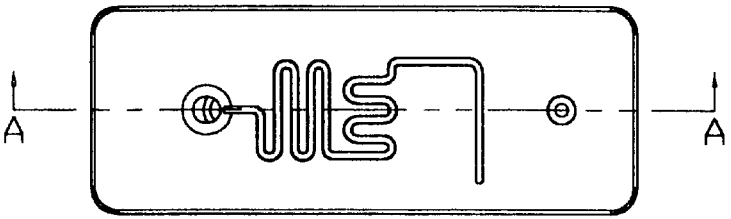
FIG. 3 is a top view of an embodiment of the present invention.
Figure 5:
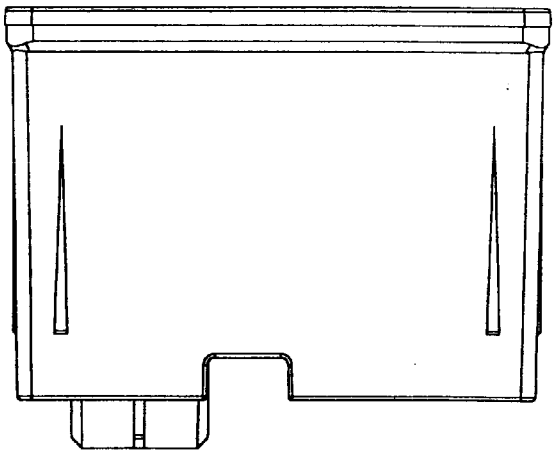
FIG. 5 is a side view of an embodiment of the present invention.
Figure 4A:
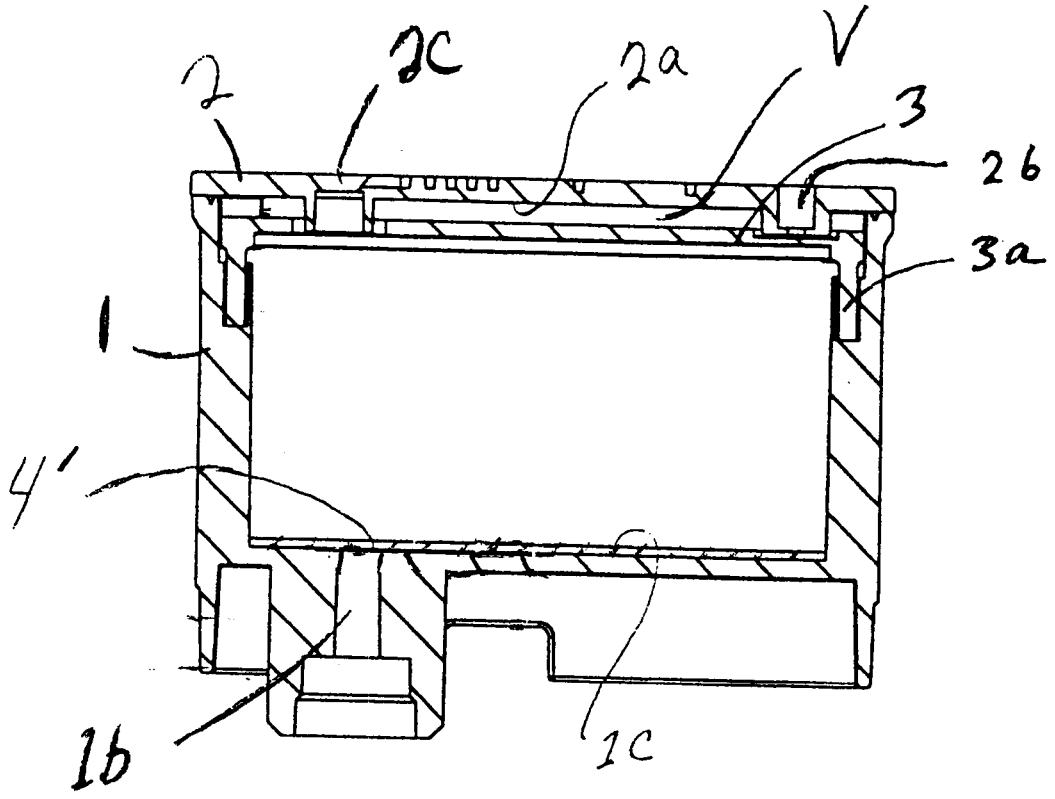
FIG. 4A shows an alternate embodiment, otherwise similar to FIG. 4.

A feature of the base 1 is that it forms an essentially flat bottomed interior section floor 1*c*, as shown in the Section view A—A (FIG. 4). The floor 1*c* supports the foam reservoir 5. In one embodiment, floor 1*c* has a recessed pocket 1*d* for the purpose of receiving the screen 4 so that screen 4 will form a flush surface and the interior surface 1*c* will be substantially flat even at the interface of the screen 4 and the remainder of the floor 1*c*. In another embodiment, see FIG. 4*a*, there is no recessed pocket, and the screen 4' is a preferably fabric and is placed over the entirety of the floor 1*c*, again resulting in a flat surface. The flat surface of the floor 1*c* may be contrasted with the ridged surface of comparable previous ink cartridges.

The lid 2 has a flat lower surface, as shown in FIG. 4. The flat lower surface 2*a* avoids any interference with the clip 3 after assembly of the cartridge. The lid 2 is spaced away from the clip 3 to form a void space V between the therebetween. The void space V allows for gas communication between the interior space and the exterior of the cartridge (i.e., the atmosphere), through vent hole 2*b*. Further, the lid 2 has a through hole 2*c* allowing for the automated injection fill of the foam reservoir 5. The through hole 2*c* may be plugged after assembly.

In an embodiment, the clip 3 provides compression of the foam reservoir 5 in the top to bottom direction of the cartridge by creating a distance between the floor 1*c* and the clip that is less than the height of the foam reservoir in the absence of any pressure. This compression of the foam reservoir 5 regulates ink flow towards the nozzle port during use of the cartridge. The use of the clip allows compression of the foam, without using protrusions from the lid 2. The clip 3 is at least somewhat less wide than the interior space defined by the base 1 and lid 2, so that the foam reservoir 5 communicates directly with void space V. The clip 3 has a hole 3*b* allowing injection filling of the foam reservoir 5. In another embodiment, the clip does not provide compression but instead serves to retain the foam reservoir 5 in place. I.e., the distance between the floor 1*c* and the clip 3 is approximately the same as the height of the foam reservoir 5.

Another aspect of the invention is the incorporation of variable vertical position of the clip 3 to allow for customization of the top-bottom compression of the foam reservoir 5, and/or for different foam reservoir heights even if the clip 3 does not compress the foam reservoir 5. A higher position of the clip 3 (i.e., closer to the lid 2) will cause less compression and/or accommodate a higher foam reservoir 5 than a lower position. In a preferred embodiment, the variation is caused by varying the length of the posts 3*a*. With reference to FIG. 4, longer posts 3*a* cause the clip 3 to be closer to the lid 2 than shorter posts, and thus making the posts 3*a* longer causes less compression and making the posts 3*a* shorter causes relatively greater compression. It will thus be appreciated that very simple adjustments allow for variation of the level of compression of the foam reservoir 5 or adjustment of the height of the foam 5. Variable vertical position may be caused by other means, all of which may be incorporated into the present invention.

An optional feature of the foam reservoir 5 is the inclusion of notches 5*a* along the vertical length of the reservoir 5 that provide clearance for the boss receptacles 1*a*. This allows the foam reservoir 5 to be seated within the interior space without any void spaces between the foam reservoir 5 and the interior walls of the base 1. There is of course a void space between foam reservoir and the lid 2, as discussed above.

Figure 6:
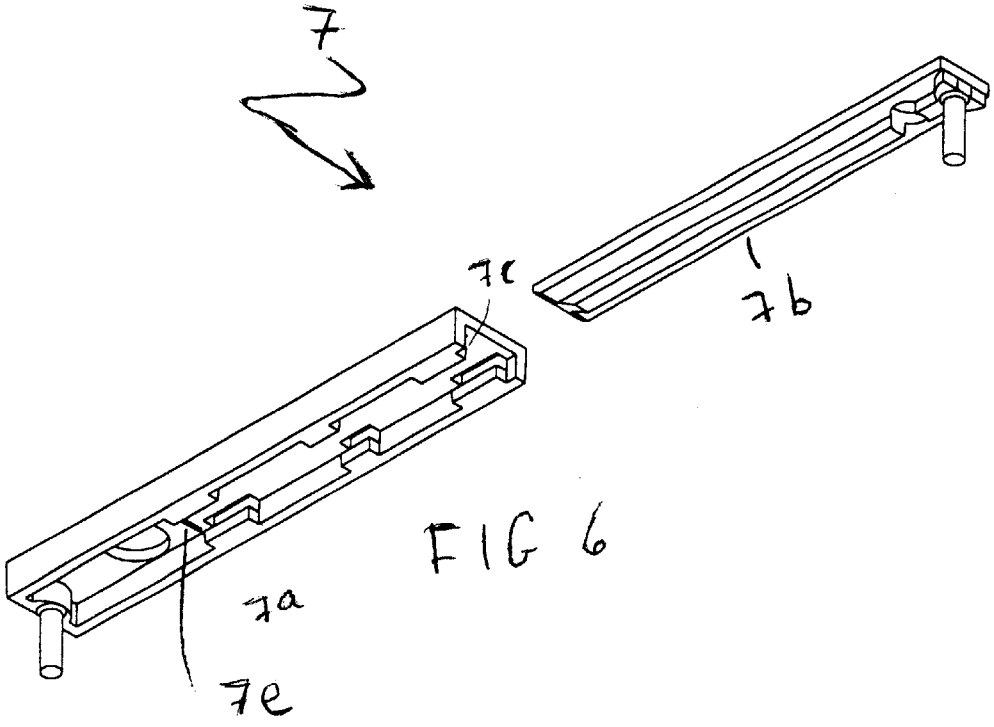
FIG. 6 is a perspective view taken from above of an embodiment of the present invention, directed to a clip.
Figure 7:
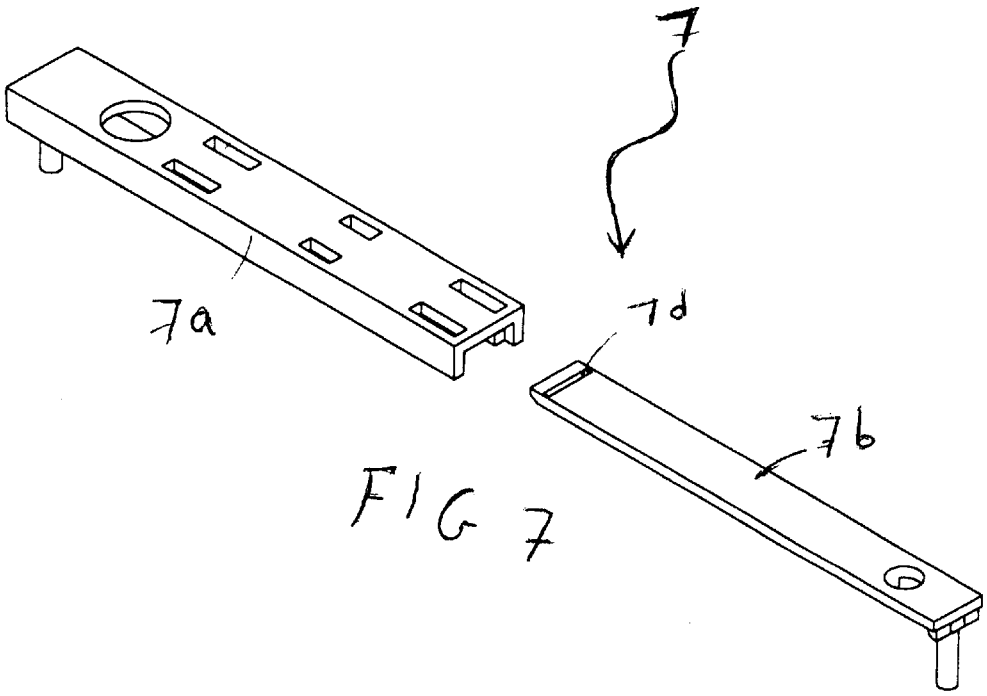
FIG. 7 is a perspective view taken from below of an embodiment of the present invention, directed to a clip.

Another aspect of the invention is described in connection with FIGS. 6 and 7. A clip having generally the same functionality and purpose as clip 3 is denoted as reference number 7. It is formed of 2 pieces 7*a* and 7*b* that engage each other at a variable position to allow for overall variance of the length of clip 7. Piece 7*b* slides into a groove 7*c* formed within piece 7*a* to form a tongue and groove connection. Piece 7*b* has a raised protrusion 7*d* which forms a detent element with a series of mating receptacles 7*e* formed above the groove 7*c* in piece 7*a*. Sliding piece 7*b* so that protrusion 7*d* engages various receptacles 7*e* (one of which is shown; the invention includes any desired number) adjusts the width of clip 7 to a desired width. This allows the same clip 7 to be used in various designs of a cartridge according to the present invention having varying widths, thus saving in tooling and manufacturing costs.

It will be appreciated that a number of features of the cartridge have been described above, and that not every feature need be incorporated into any particular embodiment of the invention disclosed herein. Further, the scope of any claims arising from this application shall be limited only by the scope and content of the prior art.

What is claimed is:

1. A printer cartridge comprising:

a base and a lid engaging the base, the combination of the base and lid defining the exterior of the cartridge and defining an interior chamber having a width;

a foam reservoir for storing ink situated within the interior chamber, the foam member being supported by the base;

a clip situated in the interior chamber for retaining the foam reservoir in place, the clip being situated beneath the lid so that a void space exists between the foam reservoir and the lid, the clip having a width less than the width of the interior chamber; wherein the clip does not contact the lid.

2. The printer cartridge of claim 1, wherein the clip has at least one post which fits into a boss situated within the interior chamber, thereby securing the clip to the base.

3. The printer cartridge of claim 1, wherein the base has a flat surface which supports the foam reservoir.

4. The printer cartridge of claim 1, wherein the lid has a vent.

5. The printer cartridge of claim 1, wherein the foam reservoir is situated within the base so that there is no void space between the foam reservoir and the base.

6. The printer cartridge of claim 5, wherein the foam reservoir has at least one notch cut to provide clearance for a boss situated within the base.

7. The printer cartridge of claim 1, wherein the clip has a hole allowing injection filling of the foam reservoir.

8. The printer cartridge of claim 1, wherein the clip compresses the foam reservoir.

9. A printer cartridge comprising:

a base and a lid engaging the base, the combination of the base and lid defining the exterior of the cartridge and defining an interior chamber having a width;

a foam reservoir for storm ink situated within the interior chamber, the foam member being supported by the base;

a clip situated in the interior chamber for retaining the foam reservoir in place, the clip being situated beneath the lid so that a void space exists between the foam reservoir and the lid, and the clip having a width less than the width of the interior chamber, wherein the clip is formed of 2 pieces which engage each other at a variable position so that the width of the clip can be adjusted.

10. The printer cartridge of claim 9, wherein the two pieces engage each other via a tongue and groove connection.

* * * * *